United States Patent [19]

von Recklinghausen

[11] Patent Number: 4,579,193

[45] Date of Patent: Apr. 1, 1986

[54] ACOUSTIC CONNECTOR

[75] Inventor: Daniel R. von Recklinghausen, Hudson, N.H.

[73] Assignee: American Electromedics Corp., Hudson, N.H.

[21] Appl. No.: 638,873

[22] Filed: Aug. 8, 1984

[51] Int. Cl.[4] ..... G10K 11/00

[52] U.S. Cl. ..... 181/175; 181/22

[58] Field of Search ..... 181/129, 130, 135, 137, 181/18, 21, 22, 175; 179/107 R, 107 E, 107 FD; 381/69; 285/319, DIG. 22

[56] References Cited

U.S. PATENT DOCUMENTS

| | | | |
|---|---|---|---|
| 2,487,038 | 11/1949 | Baum | 181/135 |
| 2,985,469 | 5/1961 | Bowman, Jr. | 285/DIG. 11 X |
| 3,080,011 | 3/1963 | Henderson | 181/135 |
| 3,882,848 | 5/1975 | Klar et al. | 181/135 X |
| 3,999,625 | 12/1976 | Pickett et al. | 181/131 |

*Primary Examiner*—Benjamin R. Fuller

*Attorney, Agent, or Firm*—Kane, Dalsimer, Kane, Sullivan and Kurucz

[57] ABSTRACT

An acoustic connector is shown for coupling two devices. One device is provided with a hub while the other has a cylindrical member which mates with the hub to provide a permanent coupling therebetween. The member is hollow to conduct acoustic signals between the devices.

3 Claims, 5 Drawing Figures

ACOUSTIC CONNECTOR

BACKGROUND OF THE INVENTION

1. Field of Invention

The present invention relates to improvements in acoustic connectors where transmittal of sound between an acoustic device and an acoustic transducer is to be accomplished.

2. Description of the Prior Art

In prior art, acoustic connectors linking an acoustic device to an acoustic transducer have been of the temporary type, such as the entertainment headset connection in commercial aircraft, or of the permanent type requiring tools such as industrial pressure transducer connections.

OBJECTS AND SUMMARY OF THE INVENTION

A principal object of the present invention is to provide a relatively simple yet permanent acoustical connector.

A further object is to provide a connector which is relatively easy to manufacture by using well-known plastic molding techniques.

Other objects and advantages of the invention shall become apparent from the following description of the invention. The acoustical connnector taught by the present invention comprises an annular housing affixed to a device generating or receiving acoustical signals and mating member concentrically disposed within the housing. Means are provided for mechanically interlocking the two members.

In the present invention, a permanent acoustic connection is achieved without the need to employ tools.

DETAILED DESCRIPTION OF THE INVENTION

Figure 1:
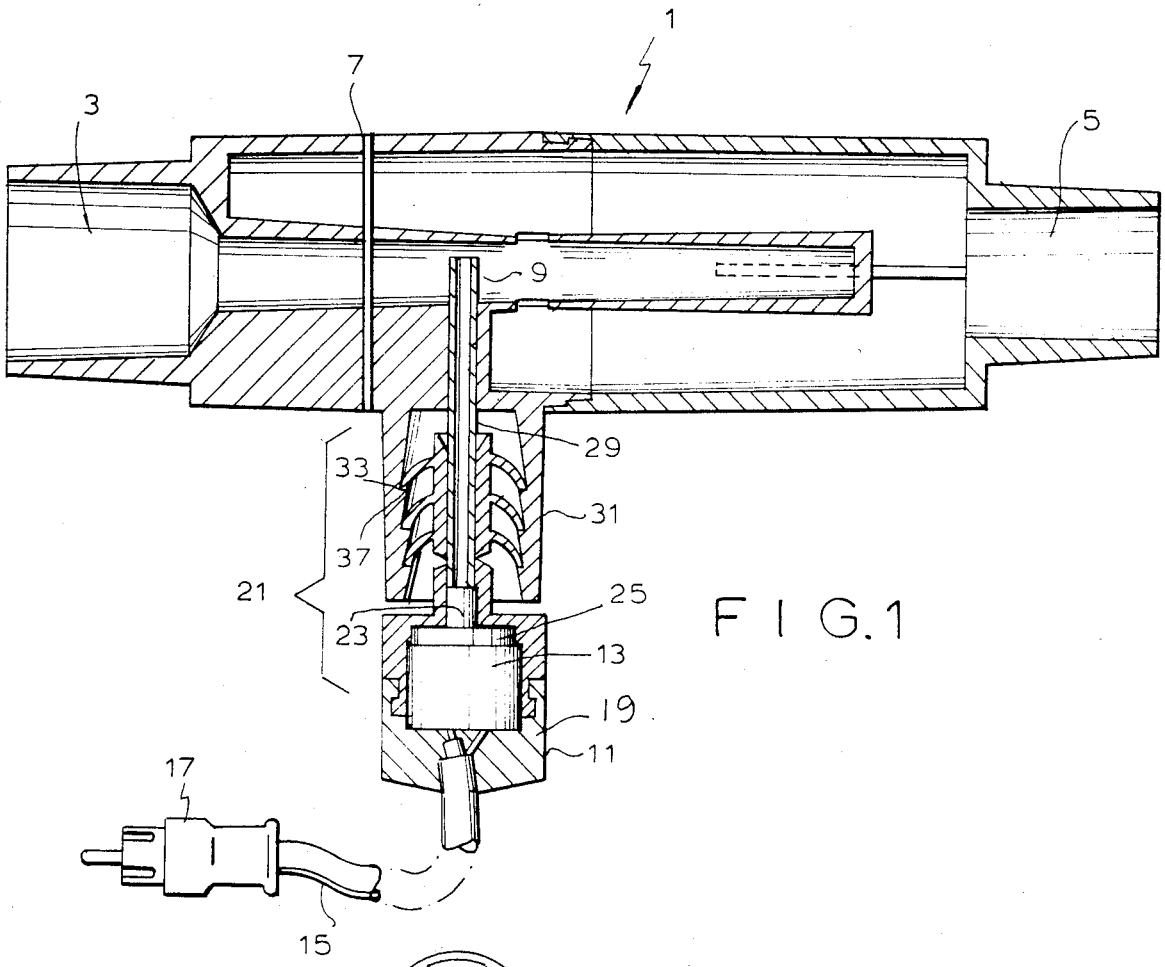
FIG. 1 shows a first embodiment of the invention connected to an acoustic device.

The invention will now be described with reference to the drawing showing the acoustic connector mating an acoustic device with an acoustic transducer.

The acoustic device, for purposes of description of a preferred embodiment is a vortex generator assembly 1 consisting of an inlet section 3, outlet section 5, vortex pin 7 and sound tube 9 which couples the acoustic device to the transducer while being a permanent part of the acoustic device. A more complete description of this device is found in my co-pending application Ser. No. 638,753 filed on even date herewith entitled "Gas Flow Monitor Using a Vortex Generator" incorporated herein by reference.

It should be understood however that the present teachings are equally applicable to other acoustic devices.

An acoustic transducer, for purposes of this disclosure comprises a molded microphone assembly 11, consisting of microphone 13 connected via cable 15 to a standard audio electrical connector 17 for connection to other equipment. Microphone cable molding 19 fastens female connector 21 to microphone 13 and cable 15. The purpose of the connector is to conduct acoustical signals from assembly 1 to microphone 13.

Figure 2:
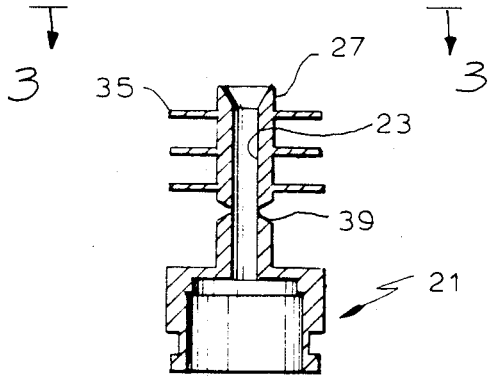
FIG. 2 shows detailed side view of the embodiment of FIG. 1.

Connector 21 as shown in FIGS. 1 and 2 has a tubular sound entrance section 27 permitting sound to travel via tubular aperture 23 to space 25 and thence to microphone 13. The lower extension 29 of sound tube 9 has an exterior shape and dimension to fit snugly within tubular aperture 23 of female connector 21.

To insure mechanical stability of the connection and to protect sound tube 9, an annular hub 31 is provided which is concentric with sound tube and is an integral part of inlet section 3 and acts as a guide for inserting sound tube 9 into connector 21. Maximum insertion is accomplished when gap between hub 31 and connector 21 is closed.

Figure 3:
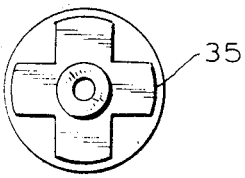
FIG. 3 shows an end view of FIG. 2.

Hub 31 has a plurality of axially spaced circumferential serrations or grooves 33 on its interior wall while connector 21 has radial fins 35 affixed to tubular sound entrance section 27. The fins 35 and serrations 33 are arranged and constructed so that when connector 21 is fully inserted into hub 31, fins 35 bend toward the axis of connector 21 and microphones 13 and by their elasticity snap into serrations 33 thus creating a positive mechanic interlock therewith. Preferably the serrations have a circumferential wall extending radialy as at 37 which prevents the withdrawal of connector 21. Fins 33 are partitioned into four sections arranged in the shape of an X as shown in FIG. 3.

Consequently an acoustic seal is created between the acoustical device and the microphone and the permanency of this connection is assured by the interlock between the serrations 33 and fins 35. To make this connection tamperproof, sound entrance section 27 is connected to connector 21 via a frangible section 39 having a reduced wall thickness which will break when connector disassembly is attempted, thereby giving evidence of tampering.

Figure 4:
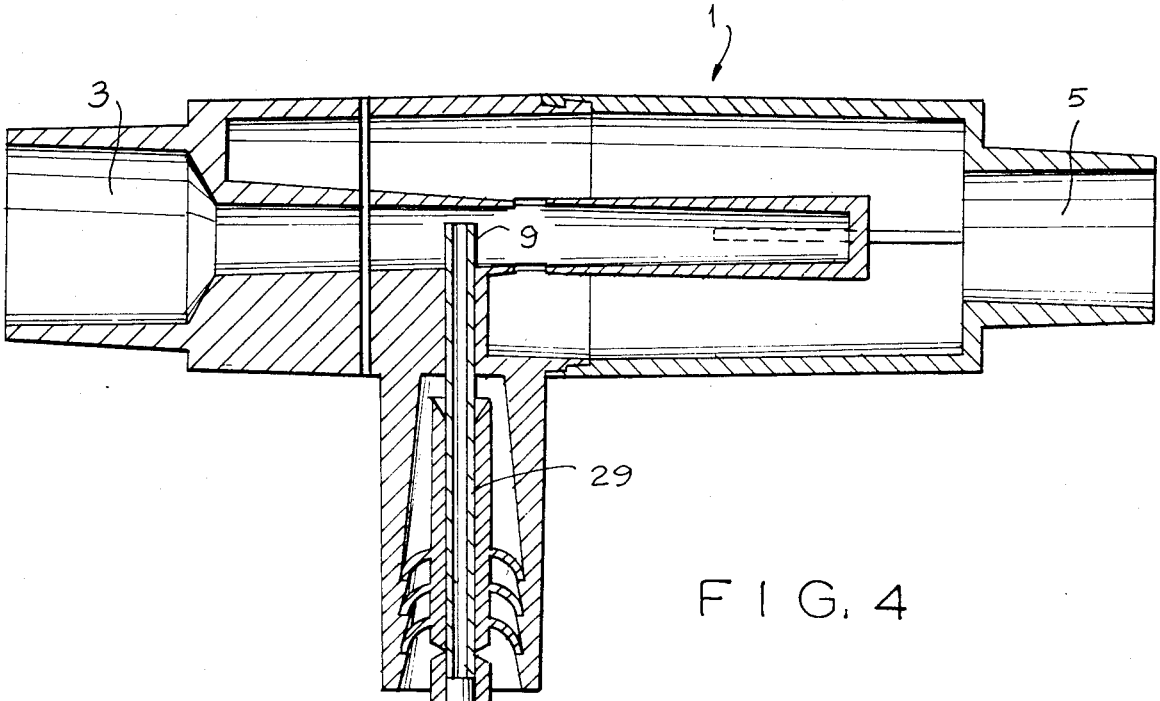
FIG. 4 shows a second embodiment of the invention.
Figure 5:
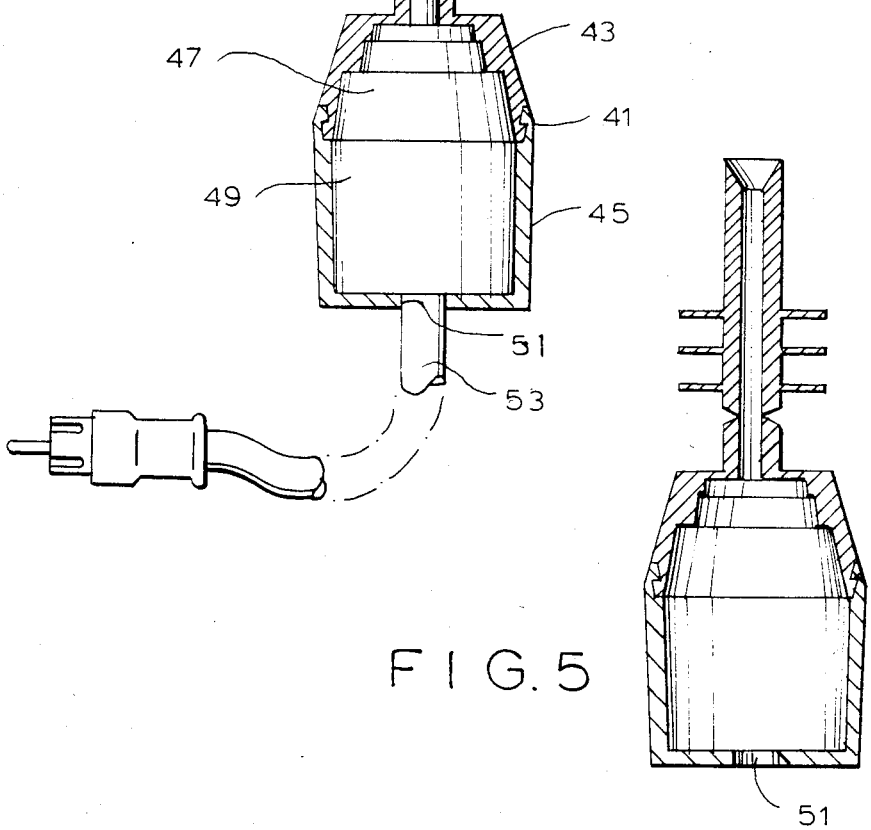
FIG. 5 shows a side sectional view of the embodiment of FIG. 4.

In the embodiment of FIGS. 1 and 2 the connector is adapted to be snapped on to a microphone having an integral housing as described above. In the embodiment of FIGS. 4 and 5, the connector is provided with a microphone cavity 41 comprising a female connector 43 and a male connector 45, which when mated form a cavity for housing a disc shaped microphone 47. Furthermore sufficient space is provided in cavity 41 for a microphone connector 49 which terminates a wire 51 disposed in hole 53.

Further modifications of this apparatus may be made by those skilled in the art and all such modifications are deemed to fall within the scope of claims appended herewith.

Having thus described my invention, I claim:

1. An apparatus for connecting a first device to a second device, comprising:

an annular hub permanently secured to said first device and having an inner surface;

a cylindrical hollow member affixed to said second device; and interlocking means provided between said annular hub and said member and having a plurality of axially spaced circumferential grooves disposed on said inner surface and a plurality of radial fins axially spaced and disposed on said member, said grooves and fins being arranged and constructed to force the fins to bend towards the member axis when said member is inserted in said hub and form interference fit therebetween;

said member being adapted to conduct acoustic signals between said devices when interlocked to said hub, and further including a frangible section disposed between said fins and said second device, said section being arranged and constructed to break under the influence of an excessive force.

2. The connector of claim 1 wherein said grooves have a radially extending wall constructed and arranged to prevent said member from being removed after it has been inserted into said hub by engaging said fins.

3. The connector of claim 1 wherein said first device has a sound tube positioned coaxially with respect to said hub, and said hollow member engages said sound tube.

* * * * *